US007441505B1

(12) United States Patent
Rodgers, Jr.

(10) Patent No.: US 7,441,505 B1
(45) Date of Patent: Oct. 28, 2008

(54) PROJECTILE LIGHTING SYSTEM

(76) Inventor: Willard Thomas Rodgers, Jr., 1401 Oak Haven Dr., Safety Harbor, FL (US) 34695

( * ) Notice: Subject to any disclaimer, the term of this patent is extended or adjusted under 35 U.S.C. 154(b) by 358 days.

(21) Appl. No.: 11/347,503

(22) Filed: Feb. 3, 2006

(51) Int. Cl.
*F42B 12/42* (2006.01)

(52) U.S. Cl. ..... 102/513; 102/444

(58) Field of Classification Search ..... 102/248, 102/513, 529, 444
See application file for complete search history.

(56) References Cited

U.S. PATENT DOCUMENTS 3,810,426 A * 5/1974 Baker ..... 102/513
6,095,051 A * 8/2000 Saxby ..... 102/444
6,880,467 B1 * 4/2005 Knapp ..... 102/513

* cited by examiner

*Primary Examiner*—Stephen M Johnson
(74) *Attorney, Agent, or Firm*—Edward P Dutkiewicz

(57) ABSTRACT

A case is formed of a side wall with a front and rear end. The case has a base. A projectile is formed of a side wall with a front end having a shaped section and a rear end with a base. The projectile is positioned within the case. The rear end of the projectile is spaced from the rear end of the case to form a rearward chamber. A firing assembly includes a charge within the rearward chamber and a firing means. An illumination assembly includes a source of illumination. An electrical assembly includes a timer and a switch. In this manner the source of illumination may be illuminated following igniting the charge and passage of time as determined by the timer.

6 Claims, 5 Drawing Sheets

FIG 1
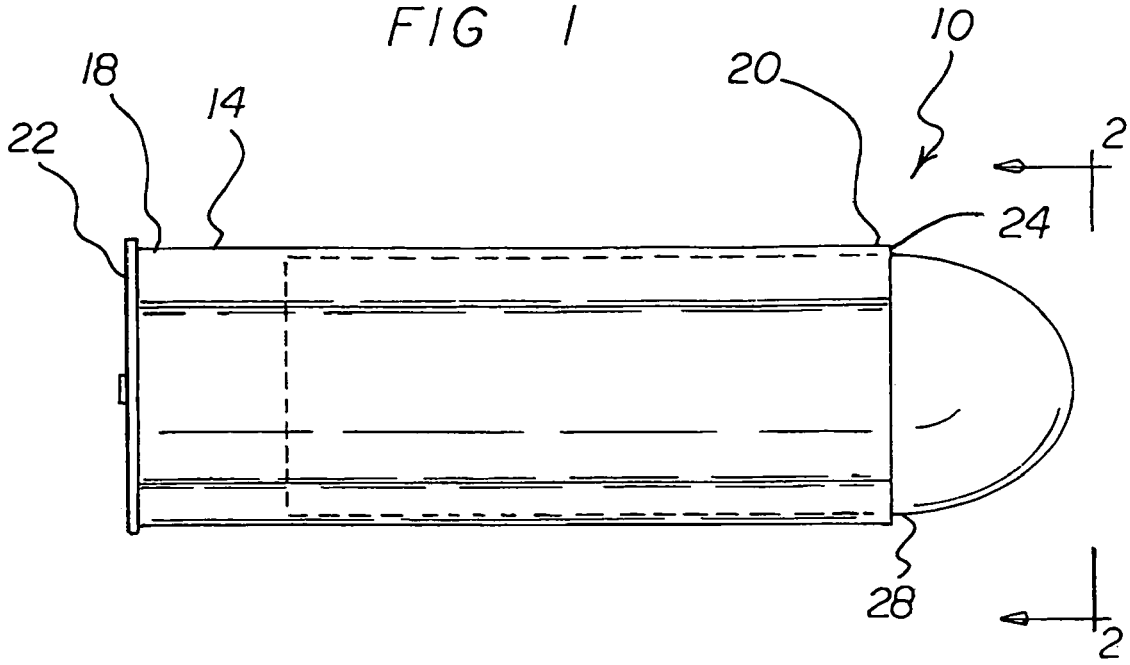
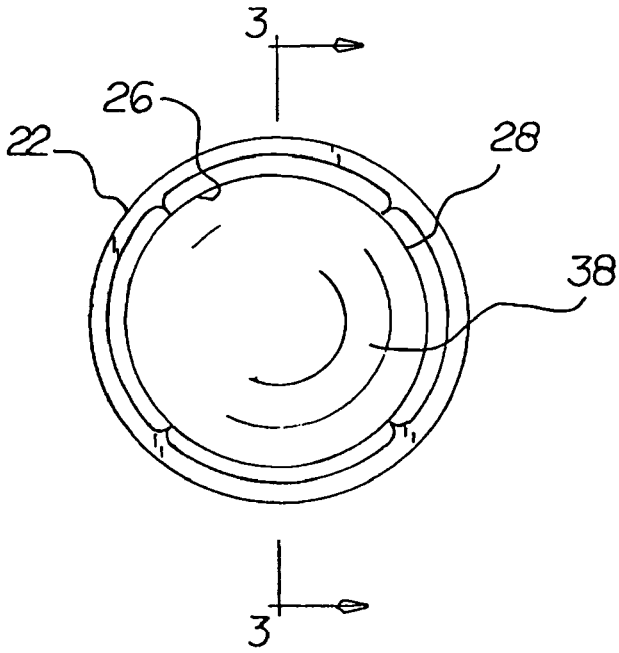
FIG 2

FIG 3
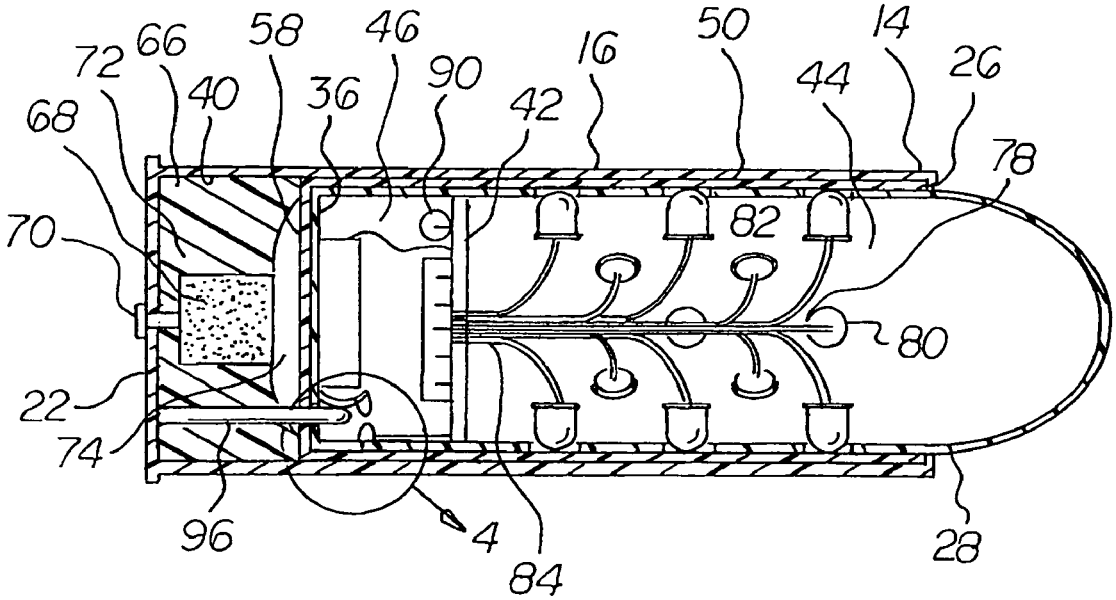
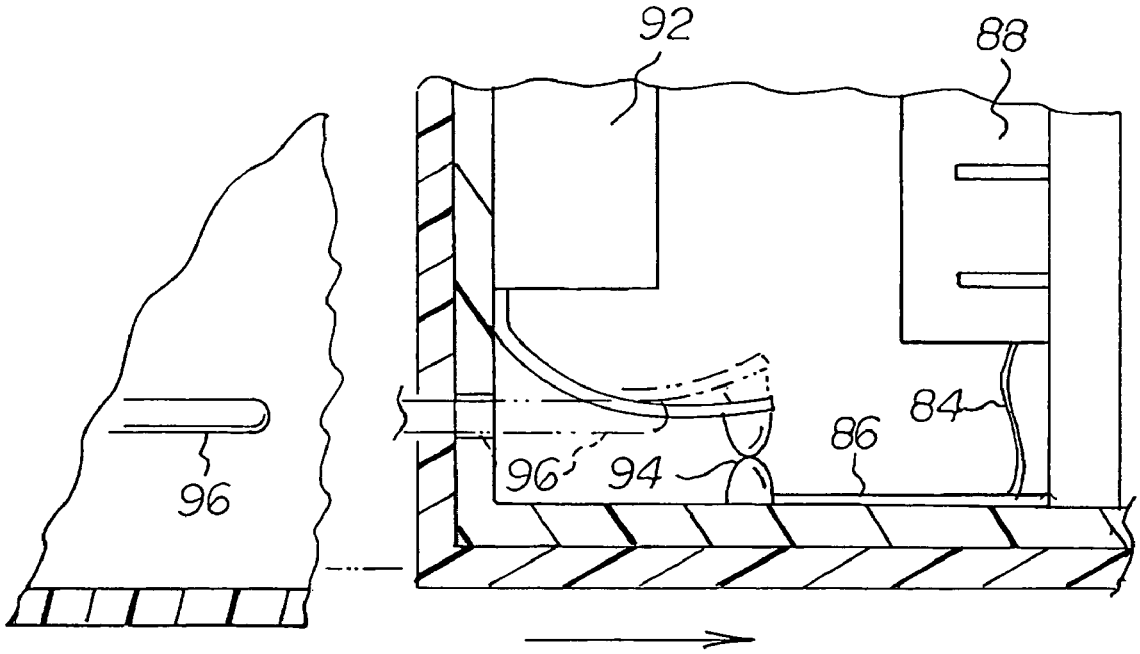
FIG 4

PROJECTILE LIGHTING SYSTEM

BACKGROUND OF THE INVENTION

1. Field of the Invention

The present invention relates to a projectile lighting system and more particularly pertains to illuminating a distant area following a time delay in a safe and reliable manner.

2. Description of the Prior Art

The use of lighting systems of known designs and configurations is known in the prior art. More specifically, lighting systems of known designs and configurations previously devised and utilized for the purpose of providing illumination through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,210,555 issued Jul. 1, 1980 to Lubbers relates to a Process for the Generation of Dense Clouds for Camouflage Purposes. U.S. Pat. No. 4,726,295 issued Feb. 23, 1988 to Adams relates to a Grenade Arrangement for Screening Clouds. U.S. Pat. No. 5,222,798 issued Jun. 29, 1993 to Adams relates to a Light Grenade. U.S. Pat. No. 5,337,671 issued Aug. 16, 1994 to Varmo relates to an Arrangement in a Smoke Shell. Lastly, U.S. Pat. No. 5,808,226 issued Sep. 15, 1998 to Allen relates to a Grenade Shell Laser System.

While these devices fulfill their respective, particular objectives and requirements, the aforementioned patents do not describe a projectile lighting system that allows for illuminating a distant area following a time delay in a safe and reliable manner.

In this respect, the projectile lighting system according to the present invention substantially departs from the conventional concepts and designs of the prior art, and in doing so provides an apparatus primarily developed for the purpose of illuminating a distant area following a time delay in a safe and reliable manner.

Therefore, it can be appreciated that there exists a continuing need for a new and improved projectile lighting system which can be used for illuminating a distant area following a time delay in a safe and reliable manner. In this regard, the present invention substantially fulfills this need.

SUMMARY OF THE INVENTION

In view of the foregoing disadvantages inherent in the known types of lighting systems of known designs and configurations now present in the prior art, the present invention provides an improved projectile lighting system. As such, the general purpose of the present invention, which will be described subsequently in greater detail, is to provide a new and improved projectile lighting system and method which has all the advantages of the prior art and none of the disadvantages.

To attain this, the present invention essentially comprises a projectile lighting system. First provided is a hollow case. The hollow case is formed of a cylindrical side wall. The case has a rear end and a front end. The rear end has a circular base. The base is formed integrally with the side wall. The front end has an opening. The opening has an inwardly extending radial flange. The case is fabricated of a rigid material selected from the class of rigid metals including steel, aluminum, beryllium, plastic or other rigid synthetic materials that resist flexing.

A hollow projectile is provided. The hollow projectile is formed of a cylindrical side wall. The projectile has a rear end and a front end. The rear end has a circular base. The base is coupled to the side wall. The front end has a hemispherically shaped section. The section extends forwardly from the side wall. The projectile is positioned within the case. The rear end of the projectile is spaced from the rear end of the case. In this manner a rearward chamber is formed. The projectile is hollow. The projectile has a circular fire wall. The fire wall is provided parallel with and forwardly of the circular base of the projectile. In this manner a forward chamber is formed. An intermediate chamber is provided. The intermediate chamber is provided between the forward and rearward chambers. The projectile is fabricated of a rigid material selected from the class of rigid metals including steel, aluminum, beryllium, plastic and other rigid synthetics.

Provided next is a hollow sabot. The sabot is formed of a cylindrical side wall. The sabot has a rear end and a front end. The rear end has a circular base. The base is formed integrally with the side wall. The front end has an opening. The front end has a leading edge. The leading edge is in contact with the radial flange. The side wall and base of the sabot have an interior. The interior is in contact with the side wall and base of the projectile. The side wall of the sabot has an exterior. The exterior is in contact with the side wall of the case. The sabot is fabricated of a frangible material. The frangible material is selected from the class of frangible materials. The class of frangible materials includes paper, cardboard, plastic and a foam based material.

A firing assembly is provided. The firing assembly includes an explosive propellant charge. The explosive propellant charge is provided in the rearward chamber in contact with the base of the case. The firing assembly also includes a firing pin. The firing means activates a primer (not shown) which is located at the base of the case in contact with the propellant charge. The firing assembly includes a plastic support. The plastic support is provided within the rearward chamber to contact and support the propellant charge. An air space is in the rearward chamber between the base of the sabot and the propellant charge.

Further provided is an illumination assembly. The illumination assembly is provided in the forward chamber. The illumination assembly includes apertures in the side wall of the projectile. The illumination assembly includes sources of ultraviolet illumination in the apertures. The illumination assembly further includes electrical leads. The electrical leads extend from the sources to and through the fire wall.

Provided last is an electrical assembly. The electrical assembly includes a printed circuit board, a timer, a battery, a switch and a trigger rod. The trigger rod is secured to the base of the case. The trigger rod extends into the intermediate chamber. In this manner the switch is urged into an open orientation when the projectile is in the case prior to igniting the propellant charge. The trigger rod is adapted to separate from the switch upon igniting the propellant charge. Movement of the projectile from the case activates the circuit to illuminate the sources of illumination following a passage of time as determined by the timer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved projectile lighting system which has all of the advantages of the prior art lighting systems of known designs and configurations and none of the disadvantages.

It is another object of the present invention to provide a new and improved projectile lighting system which may be easily and efficiently manufactured and marketed.

It is further object of the present invention to provide a new and improved projectile lighting system which is of durable and reliable constructions.

An even further object of the present invention is to provide a new and improved projectile lighting system which is susceptible of a low cost of manufacture with regard to both materials and labor, and which accordingly is then susceptible of low prices of sale to the consuming public, thereby making such projectile lighting system economically available to the buying public.

Even still another object of the present invention is to provide a projectile lighting system for illuminating a distant area following a time delay in a safe and reliable manner.

Lastly, it is an object of the present invention to provide a new and improved projectile lighting system. A case is formed of a side wall with a front and rear end. The case has a base. A projectile is formed of a side wall with a front end having a shaped section and a rear end with a base. The projectile is positioned within the case. The rear end of the projectile is spaced from the rear end of the case to form a rearward chamber. A firing assembly includes a charge within the rearward chamber and a firing means. An illumination assembly includes a source of illumination. An electrical assembly includes a timer and a switch. In this manner the source of illumination may be illuminated following igniting the charge and passage of time as determined by the timer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a projectile lighting system constructed in accordance with the principles of the present invention.

FIG. 2 is a front elevational view taken along line 2-2 of FIG. 1.

FIG. 3 is a cross sectional view taken along line 3-3 of FIG. 1.

FIG. 4 is an enlarged exploded illustration taken at circle 4 of FIG. 3.

The same reference numerals refer to the same parts throughout the various Figures.

DESCRIPTION OF THE PREFERRED EMBODIMENT

Figure 5:
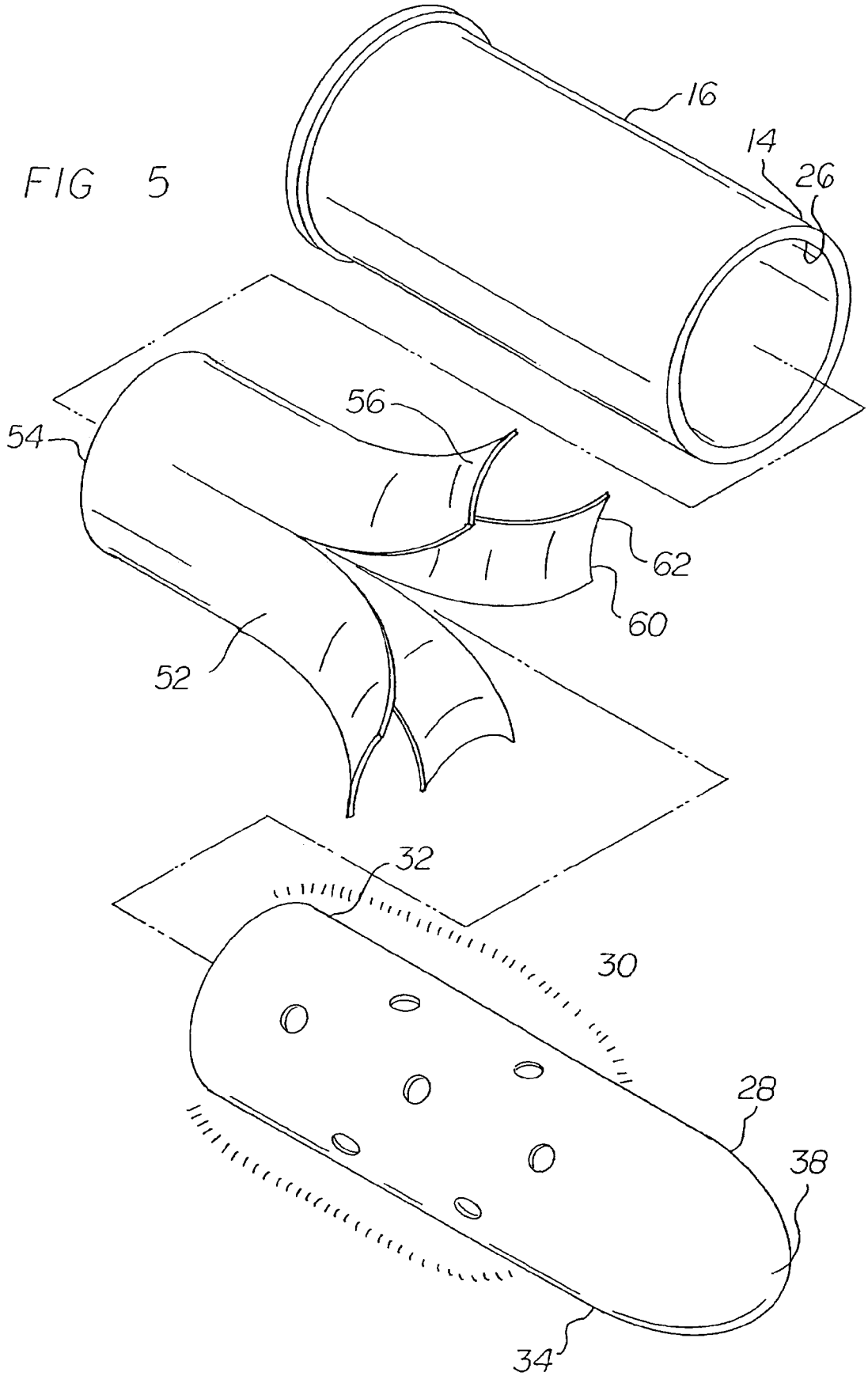
FIG. 5 is an exploded perspective illustration of the system shown in FIGS. 1 through 4.

With reference now to the drawings, and in particular to FIG. 1 thereof, the preferred embodiment of the new and improved projectile lighting system embodying the principles and concepts of the present invention and generally designated by the reference numeral 10 will be described.

The present invention, the projectile lighting system 10 is comprised of a plurality of components. Such components in their broadest context include a case, a projectile, a firing assembly, an illumination assembly and an electrical assembly. Such components are individually configured and correlated with respect to each other so as to attain the desired objective.

First provided is a hollow case 14. The hollow case is formed of a cylindrical side wall 16. The case has a rear end 18 and a front end 20. The rear end has a circular base 22. The base is formed integrally with the side wall. The front end has an opening 20. The opening has an inwardly extending radial flange 24. The case is fabricated of a rigid material. The rigid metal is selected from the class of rigid metals including steel, aluminum, beryllium, plastic or other rigid synthetic materials that resist flexing.

A hollow projectile 28 is provided. The hollow projectile is formed of a cylindrical side wall 30. One skilled in the art would recognize that the cylindrical side wall could be any geometric cylindrical configuration. The projectile has a rear end 32 and a front end 34. The rear end has a circular base 36. The base is coupled to the side wall. The front end has a hemispherically shaped section 38. The section extends forwardly from the side wall. The projectile is positioned within the case. The rear end of the projectile is spaced from the rear end of the case. In this manner a rearward chamber 40 is formed. The projectile is hollow. The projectile has a circular fire wall 42. The fire wall is provided parallel with and forwardly of the circular base of the projectile. In this manner a forward chamber 44 is formed. An intermediate chamber 46 is provided. The intermediate chamber is provided between the forward and rearward chambers. The projectile is fabricated of a rigid material. The rigid material is selected from the class of rigid material including steel, aluminum, beryllium, plastic and other rigid synthetics.

Provided next is a hollow sabot 50. The sabot is formed of a cylindrical side wall 52. The sabot has a rear end 54 and a front end 56. The rear end has a circular base 58. The base is formed integrally with the side wall. The front end has an opening 60. The front end has a leading edge 62. The leading edge is in contact with the radial flange. The side wall and base of the sabot have an interior. The interior is in contact with the side wall and base of the projectile. The side wall of the sabot has an exterior. The exterior is in contact with the side wall of the case. The sabot is fabricated of a frangible material. The frangible material is selected from the class of frangible materials including paper, cardboard, plastic, and foam based material.

A firing assembly 66 is provided. The firing assembly includes an explosive propellant charge 68. The explosive propellant charge is provided in the rearward chamber in contact with the base of the case. The firing assembly also includes a firing pin 70. The firing means activates a primer (not shown) which is located at the base of the case in contact with the propellant charge. The firing assembly includes a plastic support 72. The plastic support is provided within the rearward chamber to contact and support the propellant charge. An air space 74 is in the rearward chamber between the base of the sabot and the propellant charge. One skilled in the art would recognize that the firing means may be any device that would activate the primer, such as an elected charge or current, firing pin, striker, or hammer.

Further provided is an illumination assembly 78. The illumination assembly is provided in the forward chamber. The illumination assembly includes apertures 80 in the side wall of the projectile. The illumination assembly includes sources 82 of ultraviolet illumination in the apertures. The illumination assembly further includes electrical leads 84. The electrical leads extend from the sources to and through the fire wall.

In another embodiment, the case of the projectile would be fabricated of a clear plastic. In that case, the aperture might be omitted and the LED's or light source may be enclosed in the projectile and no apertures provided for light passage to the outside of the projectile.

Provided last is an electrical assembly 86. The electrical assembly includes a printed circuit board 88, a timer 90, a battery 92, a switch 94 and a trigger rod 96. The trigger rod is secured to the base of the case. The trigger rod extends into the intermediate chamber. In this manner the switch is urged into an open orientation when the projectile is in the case prior to igniting the propellant charge. The trigger rod is adapted to separate from the switch upon igniting the propellant charge. Movement of the projectile from the case activates the circuit to illuminate the sources of illumination following a passage of time as determined by the timer.

In an alternate embodiment of the invention the sources of illumination provide light. The light is selected from the class of lights. The class of lights includes ultraviolet light, infrared light and visible light.

Figure 6:
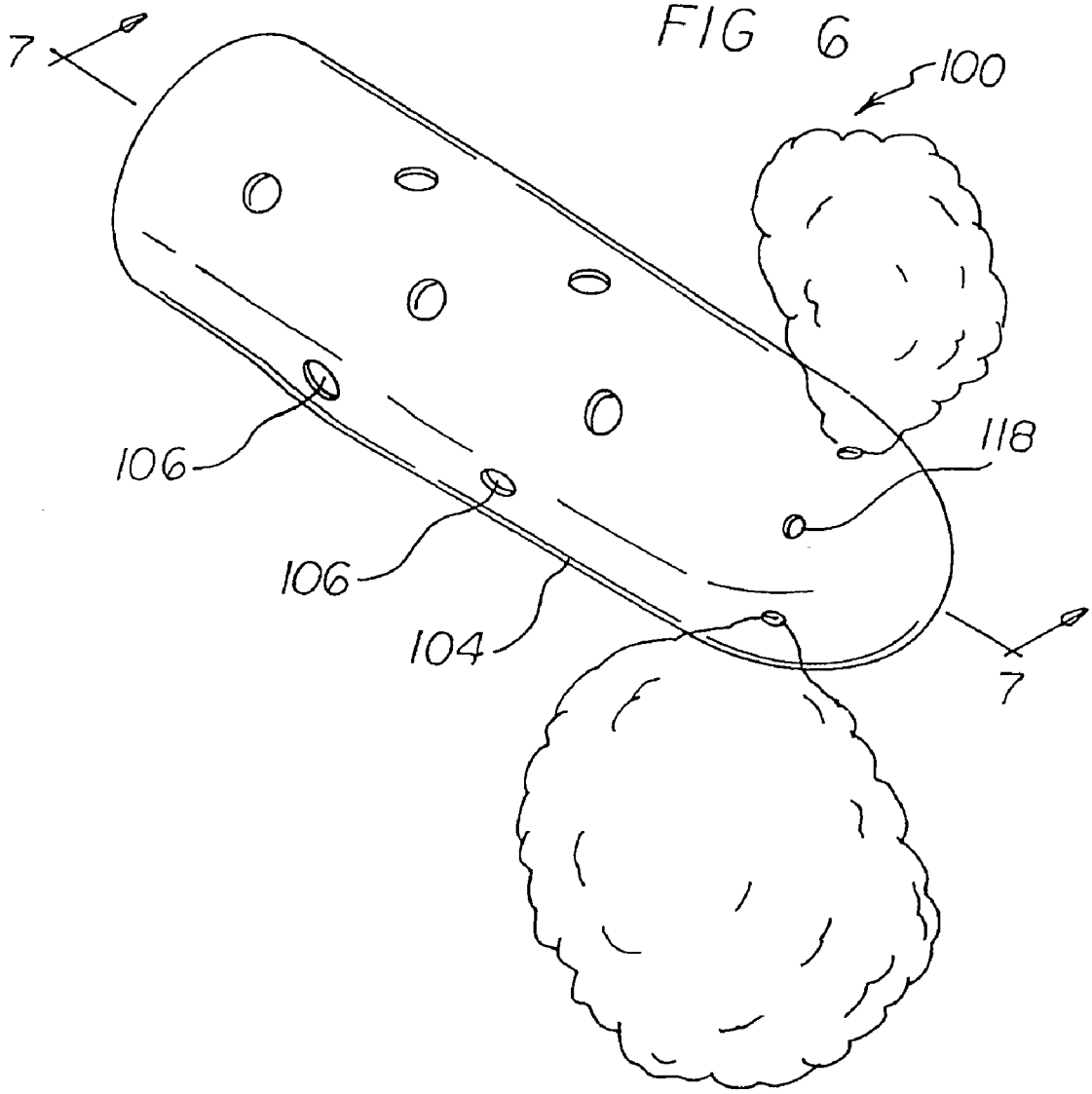
FIG. 6 is a perspective illustration of a projectile constructed in accordance with a first alternate embodiment of the invention.
Figure 7:
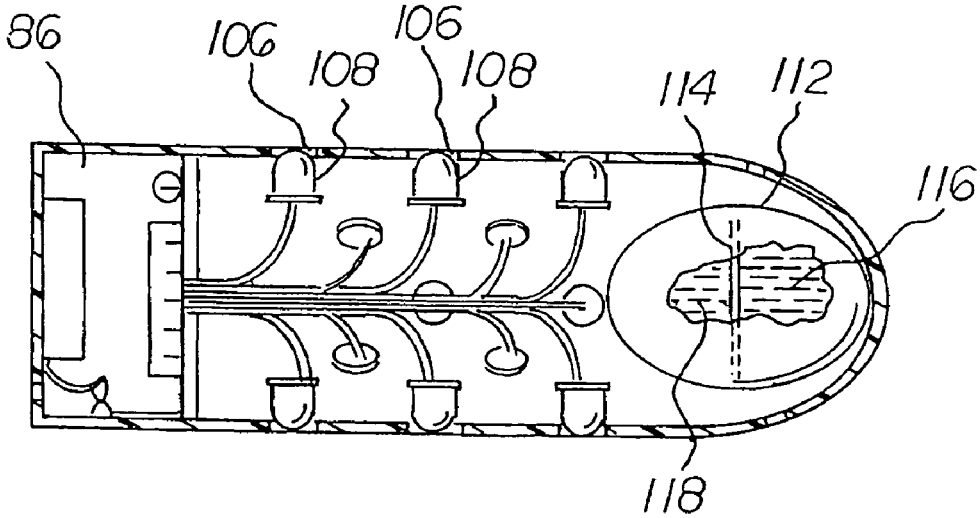
FIG. 7 is a cross sectional view taken along line 7-7 of FIG. 6.
Figure 8:
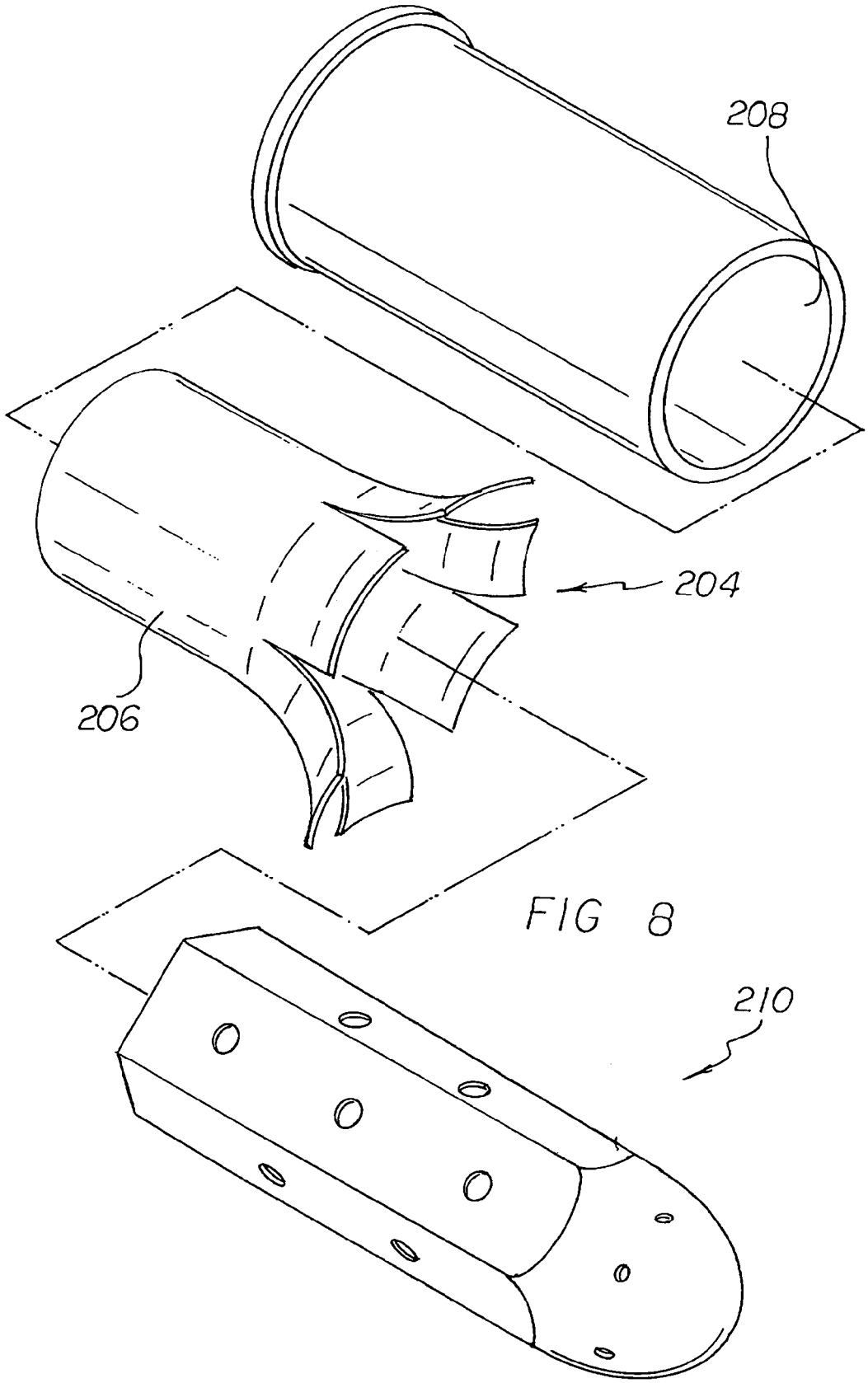
FIG. 8 is a perspective illustration of a projectile constructed in accordance with a second alternate embodiment of the invention.

Another alternate embodiment of the invention is illustrated in FIGS. 6 and 7. A projectile 104 is provided. Apertures 106 are provided. Also provided are ultraviolet light sources of illumination 108 and a container 112. The container has a central barrier 114 and chemicals 116, 118. The barrier and container are adapted to rupture after igniting the charge and projecting the projectile for the intermixing of the chemicals to create a gas cloud dispensed through at least some of the apertures. The gas cloud will obscure vision in the area of the gas cloud. Due to the ultraviolet light, however, observers with ultraviolet glasses will be able Another alternate embodiment of the invention is illustrated in FIG. 8. A sabot 204 is provided. The sabot is formed of a side wall 206. The sabot has a front and rear end and a base. The side wall and base of the sabot have an interior. The interior is in contact with the side wall and base of the projectile. The side wall of the sabot has an exterior. The exterior is in contact with the side wall of the case. The side walls of the case 208 and projectile 210 and sabot 206 are in the shape of a hexagon. The hexagon cross section of the projectile with flat faces will abate rolling of the projectile after it has landed. This will tend to allow the projectile to stay where it lands after being fired rather than roll around which it might do if it had a circular cross section.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A projectile lighting system comprising:

a case formed of a side wall with a front and rear end having a base;

a projectile formed of a side wall with a front end having a shaped section and a rear end with a base, the projectile being positioned within the case with the rear end of the projectile spaced from the rear end of the case to form a rearward chamber;

a firing assembly including a charge within the rearward chamber and a firing means;

an illumination assembly in the projectile with a source of illumination; and an electrical assembly including a timer and a printed circuit board and a battery and a switch to illuminate the sources of illumination following igniting the charge and passage of time as determined by the timer.

2. The system as set forth in claim 1 and further including:

a sabot formed of a side wall with a front and rear end with a base, the side wall and base of the sabot having an interior in contact with the side wall and base of the projectile, the side wall of the sabot having an exterior in contact with the side wall of the case.

3. The system as set forth in claim 1 wherein the source of illumination provides light selected from the class of lights including ultraviolet light, infrared light and visible light.

4. The system as set forth in claim 1 and further including:

the projectile having apertures with an ultraviolet light source of for illumination and a container having a central barrier with chemicals within the container on opposite sides of the barrier, the barrier and container adapted to rupture after igniting the charge and projecting the projectile for the intermixing of the chemicals to create a gas cloud dispensed through at least some of the apertures.

5. The system as set forth in claim 1 and further including:

a sabot formed of a side wall with a front and rear end with a base, the side wall and base of the sabot having an interior in contact with the side wall and base of the projectile, the side wall of the sabot having an exterior in contact with the side wall of the case, the side walls of the projectile being in the shape of a hexagon.

6. A projectile lighting system for illuminating a distant area following a time delay in a safe and reliable manner comprising, in combination:

a hollow case formed of a cylindrical side wall with a rear end and a front end, the rear end having a circular base formed integrally with the side wall, the front end having an opening with an inwardly extending radial flange, the case being fabricated of a rigid material selected from the class of rigid materials including steel, aluminum, beryllium, plastic or other rigid synthetic materials that resist flexing;

a hollow projectile formed of a cylindrical side wall with a rear end and a front end, the rear end having a circular base coupled to the side wall, the front end having a hemispherically shaped section extending forwardly from the side wall, the projectile being positioned within the case with the rear end of the projectile spaced from the rear end of the case to form a rearward chamber, the projectile being hollow with a circular fire wall parallel with and forwardly of the circular base of the projectile to form a forward chamber and an intermediate chamber between the forward and rearward chambers, the projectile being fabricated of a rigid material selected from the class of rigid materials including steel, aluminum, beryllium, plastic and other rigid plastics or synthetics;

a hollow sabot formed of a cylindrical side wall with a rear end and a front end, the rear end having a circular base formed integrally with the side wall, the front end having an opening with a leading edge in contact with the radial flange, the side wall and base of the sabot having an interior in contact with the side wall and base of the projectile, the side wall of the sabot having an exterior in contact with the side wall of the case, the sabot being fabricated of a frangible material selected from the class of frangible materials including paper, cardboard and plastic;

a firing assembly including an explosive propellant charge within the rearward chamber in contact with the base of the case and also including a firing pin extending through the base of the case in contact with the propellant charge, a plastic support within the rearward chamber to contact and support the propellant charge with an air space in the rearward chamber between the base of the sabot and the propellant charge;

an illumination assembly in the forward chamber including apertures in the side wall of the projectile and sources of ultraviolet illumination in the apertures with electrical leads extending from the sources to and through the fire wall; and an electrical assembly including a printed circuit board and a timer with a battery and a switch with a trigger rod secured to the base of the case and extending into the intermediate chamber urging the switch into an open orientation when the projectile is in the case prior to igniting the propellant charge, the trigger rod adapted to separate from the switch upon igniting the propellant charge and movement of the projectile from the case to activate the circuit to illuminate the sources of illumination following a passage of time as determined by the timer.

* * * * *